United States Patent [19]

Werth

[11] 4,024,950

[45] May 24, 1977

[54] MULTI-CONTAINER PACKAGE

[75] Inventor: Elmer Daniel Werth, Arvada, Colo.

[73] Assignee: Adolph Coors Company, Golden, Colo.

[22] Filed: June 21, 1976

[21] Appl. No.: 698,164

[52] U.S. Cl. ..... 206/150; 206/427; 206/498; 206/820

[51] Int. Cl.[2] ..... B65D 71/02; B65D 63/10

[58] Field of Search ..... 206/150, 199, 427, 504, 206/498, 820

[56] References Cited

UNITED STATES PATENTS

| | | | |
|---|---|---|---|
| 3,086,651 | 4/1963 | Poupitch | 206/150 |
| 3,232,422 | 2/1966 | Whyte | 206/820 X |
| 3,330,408 | 7/1967 | Wanderer | 206/150 |
| 3,778,096 | 12/1973 | Smith | 206/150 X |
| 3,785,484 | 1/1974 | Cunningham | 206/150 X |

FOREIGN PATENTS OR APPLICATIONS

| | | | |
|---|---|---|---|
| 2,157,677 | 6/1972 | Germany | 206/427 |
| 649,541 | 1/1951 | United Kingdom | 206/820 |

*Primary Examiner*—Robert S. Ward, Jr.
*Attorney, Agent, or Firm*—Bertha L. MacGregor

[57] ABSTRACT

A multi-container package in which containers are firmly bound together as a unit by means which retain the cylindrical bodies in substantially axially parallel relationship for safe transportation and handling but permit manual separation of one container from the rest of the package without dismantling the pack. The containers of each package are bound together adjacent their tops and adjacent their bottoms, with substantial lack of relative movement between the containers, but the connecting means between rows of containers and between containers of each row are weakened in such manner that only limited movement imparted in a predetermined direction is required for separating one container from the rest.

4 Claims, 6 Drawing Figures

MULTI-CONTAINER PACKAGE

BACKGROUND OF THE INVENTION

1. Field of the Invention

This invention relates to a multi-container package consisting of a plurality of cylindrical containers retained by a plurality of connected bands of stretchable plastic material to form a firmly bound package in which the containers are held in axially parallel relationship to each other. Relative movement of the containers is restrained at both top and bottom porions of the cylindrical bodies to assure safe portability and handling. Separation of one container from others in the unit is facilitated by the construction of the connecting means between the bands of plastic material which retain the containers as a unit.

2. Description of the Prior Art

The prior art discloses various forms of carriers for cylindrical containers. U.S. Pat. No. 2,874,835 shows a six pack of cans held together by a plastic sheet provided with openings which receive the upper ends of he cylindrical can bodies. Another pertinent disclosure is noted in Pat. No. 3,785,484, in which a multi-packaging device comprises a plurality of flattened bands of stretchable plastic material connected to provide a succession of bands when opened for gripping and holding containers together as a group. Both prior art carriers engage the upper of the container bodies in the unit but permit relatively free movement of the containers at and near their lower ends which results in container displacement and non-parallel positoning of the containers relatively to each other, with consequent unintended fracturing of the connecting means between the container engaging parts of the plastic sheet or bands relied on to retain the containers in a portable unit.

OBJECTS AND SUMMARY OF THE INVENTION

The object of the invention is to produce a multi-container package in which the containers are firmly bound together as a unit by means which retain the cylindrical bodies in axially parallel relationship for safe transportation but permit manual separation of one container from the rest of the package without dismantling of the pack. The package embodying this invention employs two identical binding means, one engaging the cylindrical bodies of the group adjacent their upper ends and the other adjacent their lower ends, thereby producing a package in which movement of the containers relatively to each other is substantially eliminated. The substantial lack of relative movement between the containers of this invention, firmly bound together at their top and bottom ends, would make it very difficult to separate them if prior art binding means were employed to form the package, but in this construction the means which connect the containers are a series of bands joined together by weakened means between rows of containers and between containers in a row, said means being weakened in such manner that only limited movement imparted in a predetermined direction is required for separating one container from the rest.

In this invention, the multi-container package of cylindrical containers is firmly bound together in two or more rows by two series of stretchable plastic bands connected together, one series engaging the cylindrical bodies of a group adjacent their upper ends and the other adjacent their lower ends, retaining the containers in substantially axially parallel relationship. The bands are joined together by connecting means between rows of containers and between containers in a row, said means being weakened in such manner that only limited movement imparted in a predetermined direction is required for separating one container from the rest. Due to the top and bottom binding of the containers, relative movement between them is restrained and limited. The weakening of the band connecting means between the rows of containers is such that manual grasping of a container in one row, pulling said container laterally away from an opposite container in an adjacent row, a slight distance causes fracturing of the connecting means along a vertical line. This step is followed by similar action with respect to the binding bands holding the opposite ends of the containers together. The weakening of the band connecting means between the containers of a row is such that pulling of the aforesaid container, already partly separated from the package, by a rotative movement causes fracturing of the connecting means along a horizontal line. The limited relative movement of the containers permitted by the binding means located adjacent both top and bottom ends of the containers is sufficient to enable the user to apply the force necessary to cause vertical tearing between the rows of containers and horizontal tearing between connected containers of a row.

BRIEF DESCIRPTION OF THE DRAWINGS

DESCRIPTION OF THE PREFERRED EMBODIMENT

A pulrality of cylindrical cans 10, usually six, arranged in two rows of three cans in each row, preferably are necked at their upper ends 11 to avoid having the top ends 12 protrude radially beyond the circumference of the bodies of the cans 10. Bottom ends 13 are integrally formed with the cylindrical bodies.

Figure 1:
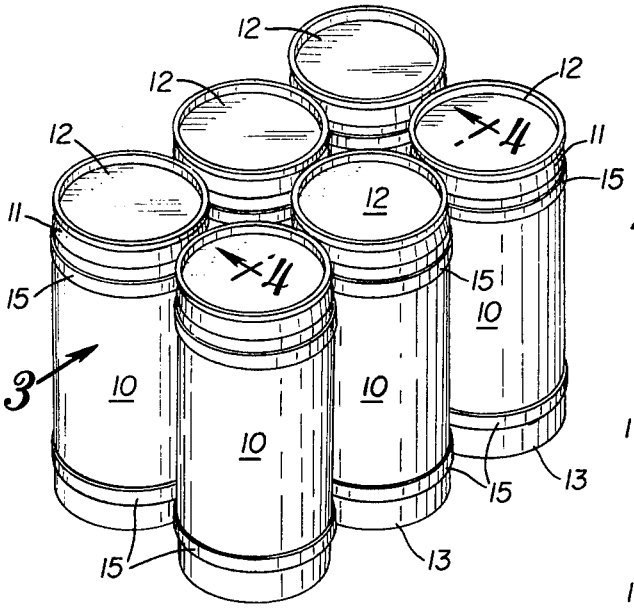
FIG. 1 is a perspective view of the multi-container package embodying this invention, showing six cylindrical containers and packaging devices applied to the upper and lower portions of the container bodies.
Figure 2:
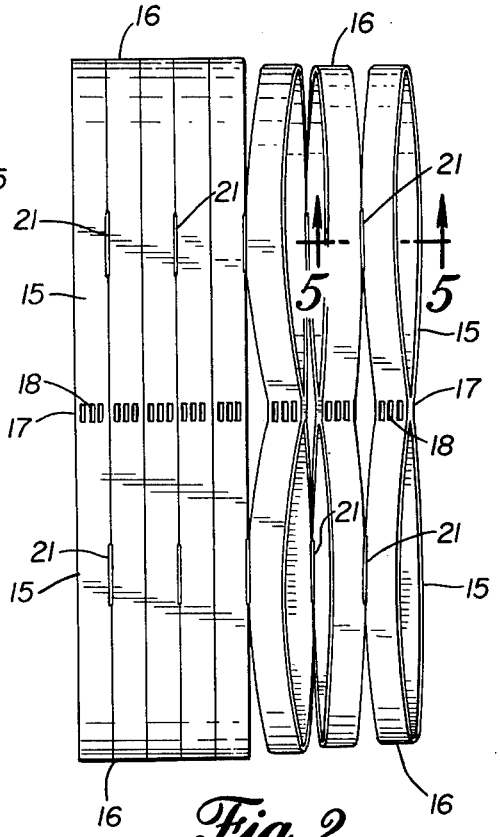
FIG. 2 is a top view of one of the packaging devices, showing a plurality of interconnected flattened bands of plastic stretchable material, some of which have been partially opened.
Figure 3:
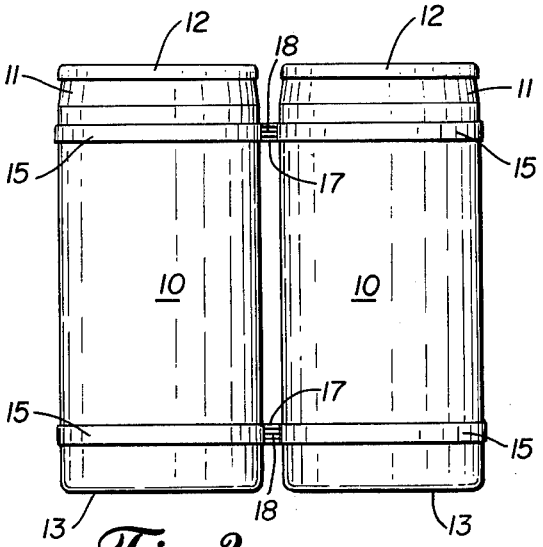
FIG. 3 is an elevational end view of one end of the package of FIG. 1, indicated by the arrow on FIG. 1.

Bands 15 flattened at sides 16 are cut from a tube of stretchable plastic material as shown in FIG. 2, where three of the bands have been partially opened, exposing upper and lower layers. At their longitudinal centers, the two layers of bands 15 are connected by thermal or other means, thus forming two bands opposite each other to engage two containers located in two rows of the package. The joined area 17, composed of double thickness of the plastic material, resists tearing unless leverage is provided by free movement of the containers at ends opposite the band-connected ends. Since the containers in the unit of this invention are bound together by two series of bands, top and bottom, such free leverage movement is not available until either the upper or lower series has been severed. To facilitate tearing of the connection 17 between opposite containers in two rows, the area 17 is provided with weakening means 18 which may be slots, diamond shpaed or other apertures, or depressed and thinned areas in the area 17, located to respond to limited pulling force by tearing along a vertical line. In the end view of FIG. 3, the space between the two rows of cans 10 has been exaggerated to clarify the construction of the connection 17.

Figure 4:
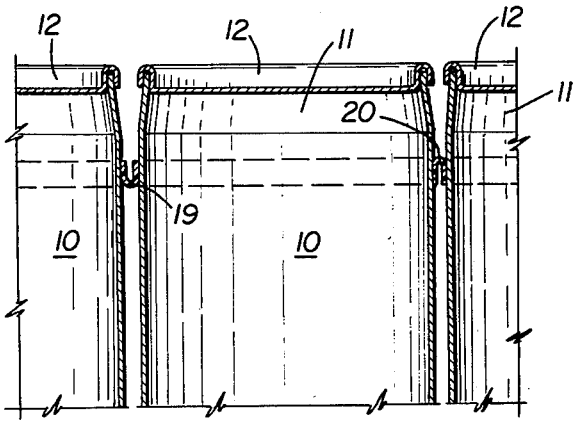
FIG. 4 is a longitudinal vertical sectional view on an enlarged scale, in the plane of the line 4—4 of FIG. 1.
Figure 5:
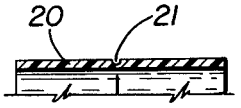
FIG. 5 is vertical sectional view of a detail showing the connecting web between two connected bands, in the plane of the line 5—5 of FIG. 2.
Figure 6:
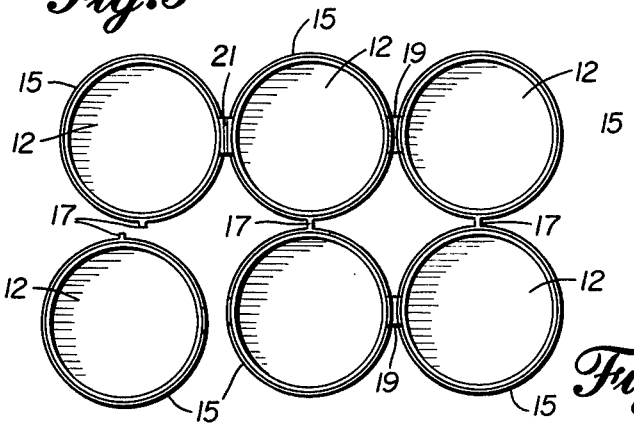
FIG. 6 is a to plan view of the package of FIG. 1, showing one of the containers separated from the remainder of the package.

The bands 15 are connected to adjacent bands on cans in the same row of containers, each by an integral web located about midway between the connection 17 and the folded side 16 of each band. Alternately, two bands 15 are connected by a web 19 between the lower edges of the bands 15 and by a web 20 between the upper edges of the bands 15 as shown in FIG. 4. The webs 19, 20 are tush located between adjacent containers of a row of containers. The webs 19 and 20 are weakened by a line 21 located midway between the connected bands and extending horizontally in the longitudinal direction of the bands 15. Thus a slight rotative movement of one can relatively to an adjacent connected can in a row causes tearing of the web, 19 or 20, between two cans, along a horizontal line. In FIG. 5, the weakened line 21 is shown as a depressed thinned line, in a web 20, on an enlarged scale, but the weakening may be produced by scoring or other well known means.

After the central connection 17 and the web 19 (or 20) of either the upper or lower series of bands 15 have been fractured, the corresponding connections of the other series of bands are easily torn because of the then available free movement of the containers held together by only the remaining one of said upper and lower series of bands.

The combination of weakening means 18 used to allow vertical tearing of area 17, and weakened line 21 used to allow horizontal rotational tearing of web 19 or 20, together provide a package having desirable rigidity and novel ease in separating individual cans. The combination of both vertical tearing and horizontal tearing needed in order to fully separate a can from either the upper or lower series of bands allows the weakened separation areas to have less resistance to tearing than would be possible if the connections joining a single band to adjacent bands were all vertical or all horizontal, since approximately perpendicular tearing forces are needed to sever in both directions most easily. Thus, a package using the described invention retains the strength desired to avoid premature separation of cans during shipping and handling while still providing commercially acceptable ease of separating the cans by the consumer.

I claim:

1. A multi-container package including a plurality of rows of cylindrical containers and a plurality of cylindrical containers in each row, comprising a. series of connected plastic bands each surrounding and engaging the cylindrical body of one of said containers adjacent its upper end, b. a second series of connected plastic bands each surrounding and engaging the cylindrical body of one of said containers adjacent its lower end, said two series of bands holding the containers in axially parallel relationship during transportation and handling, c. connecting means between the bands on containers opposite each other in a plurality of rows, said connecting means being weakened along vertical lines and tearable in response to restrained limited pulling force applied to one end of one of said opposite containers in a predetermined direction, and d. connecting means between the bands on containers adjacent each other in the same row, said connecting means being weakened along horizontal lines and tearable in response to restrained limited lateral force applied to one of said adjacent containers in the same row in another predetermined direction.

2. The package defined by claim 1, in which the connecting means between bands on containers opposite each other in a plurality of rows comprise a web double the thickness of a band having a series of openings extending therethrough located adjacent each other in a vertical line parallel to the axes of the containers.

3. The package defined by claim 1, in which the connecting means between the bands on containers adjacent each other in the same row consist of a single thickness web of band material having a series of openings extending therethrough located adjacent each other in a horizontal line perpendicular to the axes of the containers.

4. The package defined by claim 3, in which the connecting webs between bands on containers adjacent each other in the same row are alternately connected to the upper and lower edges of the bands.

* * * * *